United States Patent [19]

Audeh

[11] 4,390,410

[45] Jun. 28, 1983

[54] PROCESS FOR THE PRODUCTION OF FUELS AND METAL VALUES

[75] Inventor: Costandi A. Audeh, Princeton, N.J.

[73] Assignee: Mobil Oil Corporation, New York, N.Y.

[21] Appl. No.: 375,077

[22] Filed: May 5, 1982

[51] Int. Cl.[3] ..... C10G 1/00; C10G 51/02

[52] U.S. Cl. ..... 208/8 LE; 208/67

[58] Field of Search ..... 208/67, 8 LE

[56] References Cited

U.S. PATENT DOCUMENTS

| | | | |
|---|---|---|---|
| 3,158,561 | 11/1964 | Neuworth et al. | 208/9 X |
| 4,089,772 | 5/1978 | Gorbaty et al. | 208/10 X |
| 4,090,944 | 5/1978 | Moore et al. | 208/10 |
| 4,317,711 | 3/1982 | Yan | 208/8 LE |
| 4,317,712 | 3/1982 | Farcasiu | 208/46 |

*Primary Examiner*—Delbert E. Gantz

*Assistant Examiner*—William G. Wright

*Attorney, Agent, or Firm*—Charles A. Huggett; Charles J. Speciale; L. G. Wise

[57] ABSTRACT

A process for producing liquid fuels and for recovering metal values from crude petroleum by vis-breaking the reduced crude petroleum and dealkylating the vis-broken, reduced crude by treatment with an aromatic compound and an acidic transalkylation catalyst. The liquid product from the dealkylation step is separated and the residue fraction thermally processed with coal to solubilize the coal in the aromatic residue and demetallate the residue with the coal. The coal is partly liquified in this step and the liquefaction products, together with liquids derived from the petroleum, may be hydrotreated prior to further processing e.g., in an FCC unit. The solid residue from this step may be treated to recover the metal values, especially nickel and vanadium.

15 Claims, 1 Drawing Figure

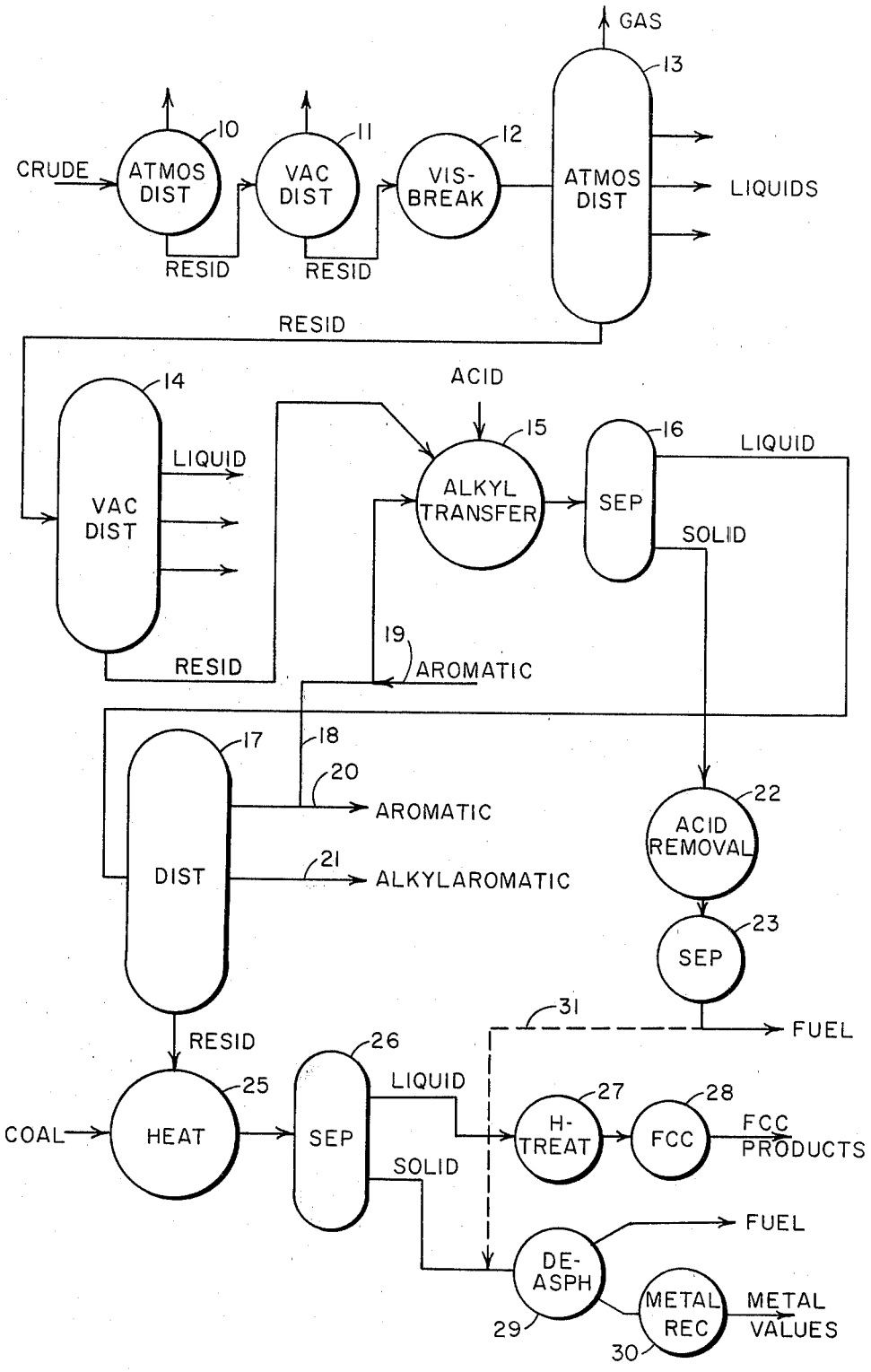
GAS
13
10
11
12
CRUDE
ATMOS DIST
VAC DIST
VIS-BREAK
ATMOS DIST
LIQUIDS
RESID
RESID
RESID
14
ACID
15
16
LIQUID
LIQUID
VAC DIST
ALKYL TRANSFER
SEP
SOLID
19
RESID
AROMATIC
17
18
20
AROMATIC
22
ACID REMOVAL
DIST
21
ALKYLAROMATIC
23
SEP
31
FUEL
RESID
26
25
LIQUID
27
28
COAL
HEAT
SEP
H-TREAT
FCC
FCC PRODUCTS
SOLID
FUEL
DE-ASPH
METAL REC
METAL VALUES
29
30

PROCESS FOR THE PRODUCTION OF FUELS AND METAL VALUES

FIELD OF THE INVENTION

This invention relates to a process for producing hydrocarbon fuels from petroleum crudes and at the same time, recovering metal values from the crude.

THE PRIOR ART

The refining of crude petroleum into various liquid products such as gasoline, distillate fuels and residual fuels has, in the course of this century become a major industry in many nations. Although the production of these liquid fuels has been the first objective of the refining industry, other products such as refinery gas, asphalt and petroleum coke have also been used in different applications, thereby making it possible to dispose of the entire consumption of crude in one way or another. Recent increases in the price of crude petroleum, together with restrictions in its availability, especially in the more desirable ligher grades, have made it desirable to increase the proportion of the more valuable lighter products, such as gasoline and distillate fuel, which is obtained from the crude. To this end, attempts have been made to convert more of the heavy higher-boiling material such as residual fuel oil and asphalt to these ligher products. These attempts are, however, made more difficult by the fact that many of the crudes which are now available—and which will be available in the future—contain greater proportions of residual materials. In addition, certain crudes such as Mexican which are highly asphaltic contain residues which are very difficult to process by conventional procedures such as coking and cracking. Residual products from crudes of this type are likely to constitute an increasingly greater proportion of refinery residua not only from the relative increase in the use of such crudes but also because they often cannot be processed into distillates from which lubricating oils can be made; unless some way is found of using these residues they will become not only difficult to dispose of but also will represent a waste of a potentially valuable resource because they do contain the basic constituents—carbon and hydrogen—from which fuels and other more desirable products are capable of being made. The problem confronting the refiner consists then, in finding a way of using these high-residue, frequently highly asphaltic, crudes to produce liquid distillate fuels including gasoline and other distillates such as kerosene, heating oil and jet fuel.

A related problem which has aggravated the difficulties inherent in processing these high residue crudes is that the residues frequently contain high concentrations of nickel and vanadium which are usually associated with a correspondingly high nitrogen content in the residue since the metals are normally present in the form of metalloporphyrins. It is the metals content of these residues which makes them unsuitable for further processing unless resort is made to demetallation procedures; such as by hydrotreating. Since these metals do have an economic value of their own it would be desirable to develop a way of recovering them.

SUMMARY OF THE INVENTION

An integrated process for the production of fuels and, concomitantly, the recovery of metal values from crude petroleum has now been developed. Although the process may, in principal, be used with any type of crude, it is of greatest utility for crudes with high proportions of asphaltic residue. Asphaltic crudes such as Mexican crude contain substantial amounts of refractory residues which are resistant to further processing by conventional procedures. The process is of especial advantage with crudes of high specific gravity which contain high concentrations of metals such as vanadium and nickel. Other contaminants such as sulfur have a minimal effect upon the operation of the process.

In the present process, a reduced crude is subjected to a preliminary vis-breaking operation and the residue from this is then dealkylated by treatment with a transalkylation catalyst, preferably a Lewis acid, in the presence of an aromatic substrate such as benzene, toluene or xylene. The dealkylation step produces a liquid product which may be used as a fuel and a residue which is treated with coal in a thermal processing step. In this step, the coal serves not only to supply combustible components to the liquid portion of the residue but also to remove the metals which can then be recovered by conventional procedures such as solvent de-ashing and solvent deasphalting. The liquid product from the coal treating step may be used as a feed for conventional heavy oil processing steps.

BRIEF DESCRIPTION OF THE DRAWINGS

The single FIGURE of the accompanying drawings is a simplified, diagrammatic flowsheet which shows how the process may be operated.

DESCRIPTION OF PREFERRED EMBODIMENTS

The petroleum crude is first subjected to the conventional distillation procedures to separate out the more volatile constituents Normally, an atmospheric distillation indicated by reference numeral 10 in the FIGURE, will be followed by a vacuum distillation 11. The vacuum residue is then passed to a vis-breaking step 12 in which it is heated in a furnace to the incipient coking temperature of the particular residue. This temperature will vary according to the nature of the crude and also of the preceding steps e.g., the composition of the crude and the final cut point in the distillation step. Normally, a temperature of at least 480° C. (900° F.) will be necessary although lower or higher temperatures may be used provided that the residence time in the vis-breaker is adjusted accordingly.

During the vis-breaking step, the residue is subjected to a mild degree of thermal cracking and to this end, the temperature and the residence time should be appropriately adjusted to ensure that excessive coking is avoided. If higher temperatures are used, the residence time should be shortened correspondingly as is conventional for this step of the process. The amount of coke formed in this step is preferably held to about 4 percent of the residue although greater amounts may be accepted. The degree of cracking which occurs should preferably be sufficient to convert at least 20 weight percent of the residue to products boiling below 400° C. (about 750° F.) and, more typically, 25 to 35 weight percent to 400° C.—products, the objective at this stage being to optimize the formation of coke. Residence times of about 1 to 10 minutes will be typical.

The vis-breaking is preferably carried out in the presence of steam in order to minimize coke deposition on the surfaces of the furnace tubes in the vis-breaker. The steam is conveniently injected with the feed, normally in an amount of 0.1 to 2 weight percent.

The products from the vis-breaker may be quenched in the normal way in order to terminate the cracking reactions at the desired point, after which the vis-broken product may be separated by distillation in the normal way, suitably in a first fractionator 13 at atmospheric pressure and then in a vacuum tower 14 to remove higher boiling fractions. The residue is then passed to the dealkylation step 15.

In the dealkylation step, the residue is treated with a light aromatic hydrocarbon and a transalkylation catalyst, preferably a Lewis acid catalyst in order to effect a transfer of hydrogen-rich alkyl side chains from the residue to the aromatic solvent which acts as a substrate. This reaction may be explained as follows:

Heavy petroleum oils in general contain a large fraction of aromatic compounds. This fraction consists of a complex mixture of high molecular weight components, many of which contain condensed aromatic and heteroaromatic rings incorporating sulfur, nitrogen and oxygen atoms in the structure. These components contain a number of hydrogen-rich aliphatic side chains having from 1 to 20 or even more carbon atoms. When a heavy petroleum oil is mixed with benzene, for example, and the mixture treated with a transalkylation catalyst such as aluminum chloride under reflux, a volatile mixture of alkylbenzenes is readily formed. Unreacted benzene and the volatile mixture of alkylbenzenes may be separated from the residual oil by distillation. The amount of residual oil recovered is substantially less than that charged. From the foregoing, it may be assumed that the postulated hydrogen-rich alkyl side chains of the residual oil have been transferred to the added benzene, i.e. that "transalkylation" has been induced, and that the residual oil which remains has been "dealkylated". This explanation is probably an oversimplification of the actual conversion in view of the complexity of the residual oil feed.

The residue is mixed with the aromatic hydrocarbon, generally in the proportion of 0.1 to 10, preferably 0.5 to 7, parts by weight of aromatic hydrocarbon per part of residue. Suitable aromatic hydrocarbons have boiling points which are normally not above 220° C. (about 430° F.) and they normally comprise mononuclear aromatic compounds which have up to two alkyl substituents although other substituents such as halogen (as in chlorobenzene) may be tolerated if these materials are conveniently available. Suitable aromatic materials include benzene, toluene, o-, m- and p-xylene, ethylbenzene, isopropylbenzene, butyl benzene and mixtures of these materials. Heterocyclic aromatics which may be alkylated may also be used.

The mixture of the vis-breaker residue and the aromatic substrate is treated by contact with a transalkylation catalyst, preferably a Lewis acid catalyst at elevated temperatures for a period of time which is sufficient to effect the desired transalkylation (dealkylation of the residue) and is typically from 0.2 to 5 hours. Temperatures of 80° C. to 350° C. are typical and pressures will normally range from atmospheric up to, for example, 2000 kPa.

The precise time, pressure and temperature of the treatment, i.e. the reaction conditions, are determined largely by the amount and kind of catalyst used, although the nature of the feed does have some bearing on the required conditions. Two parts of residue to one part of aluminum chloride, for example, gave a satisfactory conversion when refluxed for 3 hours at about 80° C., whereas with only 0.1 part of aluminum chloride no conversion under the same conditions was noted. In general, the preferred reaction conditions are those which are effective to convert at least about 10 wt. percent of the substantially nonvolatile portion of the residue charged. This conversion is readily determined by comparing the amount of 340° C.$^+$ residue on distillation of the reacted mixture with that of the residue feed before conversion.

The acid catalyst used in this step is a Lewis acid type catalyst and is preferably a Friedel-Crafts type catalyst such as aluminum chloride, hydrofluoric acid, mixtures of boron trifluoride and hydrofluoric acid, ferric chloride, titanium tetrachloride, tin tetrachloride, antimony pentachloride arsenic pentafluoride, antimony pentafluoride, phosphorus pentafluoride, boron trifluoride complexes e.g, with esters or alcohols. Bronsted acid type catalysts may also be used, for example, trifluoromethane sulfonic acid which is highly effective.

A more detailed description of a transalkylation process of this kind but using a heavy oil feedstock instead of the present vis-broken residue is found in U.S. Pat. No. 4,317,712 and reference is made to that patent for further details of the process which may be used in this step of the present process.

When the dealkylation is complete, the vis-broken residue will have been depleted of some of its hydrocarbon content, originally present as alkyl side chains on the refractory polycyclic aromatics present in the residue. With the loss of this hydrocarbon content, an even more refractory residue is obtained which is low in hydrogen. The transalkylated side chains, on the other hand, have become attached to the aromatic substrate to form a higher boiling hydrocarbon comprising a substituted aromatic which may be used as a fuel e.g., heating oil or diesel fuel or as a feedstock for further processing. To separate the liquid product, the reaction mixture from the transalkylation step is passed to a separator 16 in which the liquid product is separated from the solid by any suitable means such as settling, filtration or centrifugation. Two primary products are obtained, a liquid and a solid. The liquid is transferred to a distillation tower 17 in which it is separated into two components. The first component is a low molecular weight distillate which consists principally of unreacted aromatic substrate which is recycled to the transalkylation step 15 through pipeline 18. Make-up aromatic may be supplied through inlet 19. The recycled portion may also include low molecular weight alkylation products, especially mono-substituted mononuclear aromatics which may act as a substrate for the alkylation step. Excess aromatic material of this kind may be withdrawn through conduit 20. The second component is a higher molecular weight fraction and this product is derived from the alkyl chain transfer to the aromatic substrate. This component may be withdrawn from the distillation tower through conduit 21 and used either as a fuel or for further refinery processing. Thus, in this way, the previously unusable residue has already started to yield a more valuable fuel product.

This distillation step also yields a high boiling residue which is essentially non-distillable and which contains almost all the metal content of the original residue. The processing of this residue will be described later.

The solid product from separator 16 comprises two main components. The first is the spent acid catalyst and the second is a carbonaceous residue of a heavy, asphalt-like consistency and composition. The treatment of this solid product will depend upon the identity of the acid used but normally, the solid from separator 16 will be treated in step 22 so as to hydrolyze metal-containing acids such as aluminum chloride or to remove non-metallic acids such as hydrofluoric acid. The treated product of step 22 then comprises the carbonaceous solid which is separated from any residues in separator 23 and finally used as a fuel e.g, in solid briquettes. If a metal-containing acid such as aluminum chloride is used in the transalkylation step, the final solid product from this step may contain metallic residues from the acid but since their amount is normally small, they may be passed through to the solid fuel product. If convenient and practicable, they may be separated in separator 23 from the carbonaceous material.

The high boiling refractory residue from distillation tower 17 is then passed to a coal skimming step 25, the purpose of which is partly to liquify the coal and partly to demetallize the residue from tower 17 by the use of the coal. The refractory residue partly solubilizes the coal and a distillable product is obtained from the coal. In this step of the process, the residue is mixed with comminuted coal to form a slurry which is then co-processed at elevated temperature to solubilize the coal in the residue; the aromatic content of the residue ensures that the coal will dissolve. The slurry is heated to a temperature and for a period of time that ensures a reduction in the viscosity of the slurry but avoids excessive formation of coke; the step may therefore be regarded essentially as a vis-breaking operation which is carried out in the presence of coal. Temperatures of 400° C. to 540° C. (about 750° F. to 1000° F.) will normally be appropriate but in most cases the maximum temperature will not exceed 450° C. (about 850° F). At higher temperatures shorter residence times may be used in order to avoid excessive coking. Pressures are not critical but generally will be superatmospheric, normally in the range 800 to 10000 kPa (about 100 to 1435 psig), in order to maintain the desired liquid phase in the slurry during treating. Depending upon the temperature used, space velocity will vary according to the desired residence time; space velocities of 0.1 to 20, generally 1 to 15 LHSV relative to the coal, will be appropriate.

The coal may be of any rank ranging from lignite through sub-bituminous and bituminous coals to coking coals and anthracite. It has been found, however, that greater liquid yields are obtained with the bituminous coals than either the harder or softer coals. The bituminous coals have also been found to give a greater degree of demetallation than other coals and are therefore preferred. The amount of coal relative to the residue will generally be not more than 50 percent by weight of the total slurry in order to achieve satisfactory handling properties and in most cases, the amount of coal will not exceed 30 weight percent of the slurry. The minimum amount of coal will depend upon the degree of demetallation desired and the amount of coal liquids which are to be produced but in most cases will be at least 10 weight percent of the slurry and usually will be in the range 15 to 30 weight percent of the slurry. The degree of demetallation has been found to increase with the coal content up to about 30 weight percent of coal and with increasing temperature:demetallation at 465° C. may be greater than at 455° C., but the coal conversion may be lower at the higher temperatures with particular losses noted in conversion to coal liquids and gas. Thus, a balance may need to be struck between opposing requirements.

These effects are illustrated by the following data which show the effect of thermally processing a refinery vacuum residue, similar to that obtained from the transalkylation step, with an Illinois No. 6 Coal. The data, reported in Table 1 to 3 below show the effects of different temperatures. Table 4 illustrates the effect of using different coals.

TABLE 1

Thermal Processing of Vacuum Residue with Illinois No. 6 Coal (455° C., 2860 kPa, 12 LHSV)

| | | | | | | |
|---|---|---|---|---|---|---|
| Coal, % Wt. | 0 | 5 | 10 | 20 | 30 | 100 |
| Residue, % Wt. | 100 | 95 | 90 | 80 | 70 | 0 |
| Properties | | | | | | |
| Nickel, ppm | 53 | 54 | 54 | 55 | 57 | 65 |
| Vanadium, ppm | 250 | 238 | 227 | 205 | 181 | 20 |
| Ash, % Wt. | 0.1 | — | — | — | — | 10 |
| Liquid Product | | | | | | |
| Nickel, ppm | 53 | 50 | 42 | 34 | 32 | — |
| Vanadium, ppm | 243 | 216 | 181 | 146 | 131 | — |
| Solid Product | | | | | | |
| Nickel, ppm | — | — | 135 | 130 | 80 | 65 |
| Vanadium, ppm | — | — | 495 | 535 | 225 | 25 |

TABLE 2

Demetallation of Residue by Illinois No. 6 Coal (455° C., 2860 kPa, 12 LHSV)

| | | | | | |
|---|---|---|---|---|---|
| Coal, % Wt. | 0 | 5 | 10 | 20 | 30 |
| Residue, % Wt. | 100 | 95 | 90 | 80 | 70 |
| Yield, % Wt. | | | | | |
| Gas | 1 | 2.8 | 3.4 | 3.9 | 4.3 |
| Liquid | 99 | 96.1 | 92.5 | 86.6 | 79.5 |
| Solid | 0 | 1.1 | 4.1 | 9.5 | 16.2 |
| Total Coal | | | | | |
| Conversion, % | — | 78 | 59 | 53 | 46 |
| % of Coal Solubilized | — | 41 | 34 | 37 | 34 |
| % of Coal Converted to Gas | — | 37 | 25 | 16 | 12 |
| % Demetallation | | | | | |
| Nickel | 0 | 6 | 21 | 36 | 40 |
| Vanadium | 0 | 11 | 26 | 40 | 46 |

TABLE 3

Demetallation of Residue by Illinois No. Coal (465° C., 2860 kPa, 12 LHSV)

| | | |
|---|---|---|
| Coal, % Wt. | 20 | 30 |
| Residue, % Wt. | 80 | 70 |
| Liquid Product | | |
| Nickel, ppm (%)* | 29(45)* | 25(53)* |
| Vanadium, ppm | 120(52)* | 67(73)* |
| Solid Product | | |
| Nickel, ppm | — | 110 |
| Vanadium, ppm | — | 360 |

Note:
*Data in parentheses represent extent of demetallation of processed residue.

TABLE 4

Demetallation of Residue with Coals of Different Volatilities (465° C., 2860 kPa, 12 LHSV)

| | Coal | | | | | |
|---|---|---|---|---|---|---|
| | Bituminous* | | Sub-Bituminous | | Lignite | Silica Gel |
| % Coal Added | 20 | 30 | 20 | 30 | 30 | 20 |
| % Residue | 80 | 70 | 80 | 70 | 70 | 80 |
| Yield, % Wt. | | | | | | |
| Gas | — | — | 5 | 4 | 4 | 3 |
| Liquid | — | — | 82 | 75 | 76 | 77 |
| Solid | — | — | 13 | 21 | 20 | 20 |
| % of Coal Converted | 53 | 46 | 35 | 30 | 33 | — |
| % of Coal Solubilized | 37 | 34 | 10 | 17 | 20 | — |
| % Demetallation | | | | | | |
| Nickel | 45 | 53 | 32 | 38 | 23 | 9 |

TABLE 4-continued

Demetallation of Residue with Coals of Different Volatilities (465° C., 2860 kPa, 12 LHSV)

| | Coal | | | | | |
|---|---|---|---|---|---|---|
| | Bituminous* | | Sub-Bituminous | | Lignite | Silica Gel |
| Vanadium | 52 | 73 | 31 | 36 | 27 | 13 |
| Liquid Product | | | | | | |
| Nickel, ppm | 29 | 25 | 36 | 33 | 41 | 48 |
| Vanadium, ppm | 120 | 67 | 173 | 160 | 182 | 218 |

Note:
*Conversion and solubilization data for 455° C.

As the data in the preceding Tables demonstrate, the coal is converted in this step to liquid and gaseous products together with a carbonaceous residue which now contains most of the original metal contaminants of the residue from the transalkylation step. The liquid product which is obtained after separation in separator 26 has components which are derived both from the coal and from the petroleum. Its composition, therefore, will differ from that of traditional feedstocks derived wholly from petroleum, especially with respect to its oxygen content. Hydrotreating in step 27 may therefore be necessary before the liquid is passed to the fluid catalytic cracker 28 or other processing units. The hydrotreater 27 will be operated in a manner appropriate for the coal-derived feedstock and suitable operating conditions will be known to those who are skilled in this field.

The solid residue from the coal processing step which is obtained from separator 26 may be treated in a variety of ways to remove its liquid content. Conventional procedures such as solvent deasphalting e.g. with a solvent such as pentane, shown by reference numeral 29, or solvent deashing with a stronger solvent e.g. an aromatic to remove asphaltenes may be used to remove soluble liquids which may then be recovered from the solvent by conventional techniques and processed further as appropriate. The solid recovered from this step may be gasified to yield fuel gas and the metal values, principally nickel and vanadium, recovered as indicated at 30. The carbonaceous residue from the transalkylation step may also be treated in this step and to this end may be conveyed through transfer line 31 to the liquid removal and metal recovery steps 29 and 30.

I claim:

1. A process for producing fuels from a reduced crude petroleum which comprises:

(i) vis-breaking the reduced crude to form a residue, (ii) dealkylating the residue by contact with a transalkylation catalyst in the presence of an aromatic substrate, to form an alkylated aromatic compound and a dealkylated residue, (iii) forming a mixture of dealkylated residue from (ii) and comminuted coal, (iv) heating the mixture of product and coal to an elevated temperature to solubilize the coal in the dealkylated residue and demetallize the residue, (v) separating the products of (iv) to form a liquid portion and a solid portion.

2. A process according to claim 1 in which the reduced crude petroleum comprises a vacuum reduced crude.

3. A process according to claim 1 in which the vis-broken crude is fractioned prior to step (ii), the residue from the fractionation being dealkylated in step (iii).

4. A process according to claim 3 in which the residue from the fractionation of the vis-broken crude is dealkylated by contact with an acid transalkylation catalyst at a temperature of 80° C. to 350° C. in the presence of a monocyclic aromatic hydrocarbon substrate having a boiling point below 220° C.

5. A process according to claim 4 in which the acid transalkylation catalyst comprises a Lewis acid.

6. A process according to claim 5 in which the Lewis acid is aluminum chloride.

7. A process according to claim 4 in which the aromatic hydrocarbon substrate comprises benzene, toluene, o-, m- or p-xylene, ethylbenzene, isopropylbenzene, butylbenzene or a mixture of these.

8. A process according to claim 1 in which the reaction mixture of dealkylation step (ii) is separated into a liquid portion and a solid portion, the solid portion being treated to recover a carbonaceous fuel, the liquid portion being separated into a low boiling portion and a non-distillable, dealkylated residue which is mixed with the coal in step (iii).

9. A process according to claim 8 in which the low boiling portion comprises unreacted aromatic substrate and an alkylated aromatic product which are separated by distillation with the aromatic substrate being recycled to the transalkylation step (iii).

10. A process according to claim 8 in which the non-distillable, dealkylated residue is mixed with the comminuted coal to form a slurry which is heated to a temperature of 400° C. to 540° C. and under superatmospheric pressure to solubilize the comminuted coal in the non-distillable, dealkylated residue and to demetallate the residue.

11. A process according to claim 10 in which the coal is a bituminous coal.

12. A process according to claim 1 in which the liquid portion separated in step (v) is hydrotreated.

13. A process according to claim 1 in which the solid portion separated in step (v) is contacted with a solvent to remove residual amounts of liquid.

14. A process according to claim 13 in which the solvent-treated solid portion is treated to recover its metal values.

15. A process according to claim 8 in which the carbonaceous fuel is mixed with the solid portion separated in step (v).

* * * * *